US006644167B1

(12) United States Patent
Lindskog et al.

(10) Patent No.: US 6,644,167 B1
(45) Date of Patent: Nov. 11, 2003

(54) METHOD AND ARRANGEMENT FOR LIMITING THE DAMAGE TO A MINE CLEARANCE VEHICLE IN THE EVENT OF LARGE MINE DETONATIONS

(75) Inventors: Lars-Olov Lindskog, Karlskoga (SE); Gunnar Sjödin, Karlskoga (SE); Torgny Röjare, Storfors (SE)

(73) Assignee: Bofors Defense AB, Karlskoga (SE)

( * ) Notice: Subject to any disclaimer, the term of this patent is extended or adjusted under 35 U.S.C. 154(b) by 0 days.

(21) Appl. No.: 09/623,976

(22) PCT Filed: Feb. 24, 1999

(86) PCT No.: PCT/SE99/00252

§ 371 (c)(1),
(2), (4) Date: Nov. 29, 2000

(87) PCT Pub. No.: WO99/46554

PCT Pub. Date: Sep. 16, 1999

(30) Foreign Application Priority Data

Mar. 10, 1998 (SE) ..... 9800765

(51) Int. Cl.[7] ..... F41H 11/12

(52) U.S. Cl. ..... 89/1.13; 102/402; 172/122; 172/123

(58) Field of Search ..... 102/402; 89/1.13; 172/122–123

(56) References Cited

U.S. PATENT DOCUMENTS

| | | | | | |
|---|---|---|---|---|---|
| 2,425,357 | A | * | 8/1947 | Walker | 89/1.13 |
| 2,455,636 | A | | 12/1948 | Woolson | |
| 2,489,349 | A | * | 11/1949 | White | 89/1.13 |
| 3,498,177 | A | * | 3/1970 | Moro | 89/1.13 |
| 3,771,413 | A | * | 11/1973 | Sieg et al. | 89/1.13 |
| 4,185,698 | A | * | 1/1980 | Frisbee | 172/71 |
| 5,038,868 | A | * | 8/1991 | Rinelli | 172/48 |
| 5,346,020 | A | * | 9/1994 | Bassett | 172/540 |
| 5,712,441 | A | | 1/1998 | Grünewald | |
| 5,786,542 | A | * | 7/1998 | Petrovich et al. | 89/1.13 |
| 5,816,340 | A | * | 10/1998 | Cox et al. | 172/510 |
| 5,844,160 | A | * | 12/1998 | Cieszkiewicz | 89/1.13 |
| 5,979,289 | A | * | 11/1999 | French | 89/1.13 |
| 6,182,769 | B1 | * | 2/2001 | Karlen | 89/1.13 |
| 6,382,069 | B1 | * | 5/2002 | Haughom et al. | 89/1.13 |

FOREIGN PATENT DOCUMENTS

| | | | |
|---|---|---|---|
| DE | 4442135 C1 | | 1/1996 |
| GB | 2149357 A | * | 6/1985 |
| SE | WO 96/37752 | * | 11/1996 |
| WO | WO-95/32402 | | 11/1995 |
| WO | WO-97/08508 | | 3/1997 |

* cited by examiner

*Primary Examiner*—Michael J. Carone
(74) *Attorney, Agent, or Firm*—Connolly Bove Lodge & Hutz LLP

(57) ABSTRACT

The present invention relates to a method and an arrangement to mitigate damage to a rotary cultivator type mine clearer. In the event of detonations, triggered by the mine clearance tool, the present invention acts to mitigate damage to the mine-clearing tool, the mechanical mine clearer drive function, and its suspension. Detonation forces are, in a first stage, damped by hydraulic and/or mechanical damping members which are coupled between the bearing points of the tool and the engine driving the tool and which connect those parts to form a combined unit. If the detonation force is not absorbed, then, in a second stage, the detonation force remaining after the first stage damping, is counter to some of the combined weight of a unit formed by the tool, its bearings and the engine driving the tool. In response to the detonation force remaining, after first stage damping, the damping members pivot the unit upwards about a transverse axis allowing the detonation force, remaining after the first stage damping, to be expended lifting the mine clearance tool from the detonation site. If detonation force remains, then, in a third stage, the damping members channel the detonation force remaining, after first and second stage damping, through a deformation zone between groundworking parts and the bearings supporting the mine clearance tool, absorbing the remaining detonation force in the deformation zone, without affecting the bearings.

8 Claims, 4 Drawing Sheets

Figure 1:
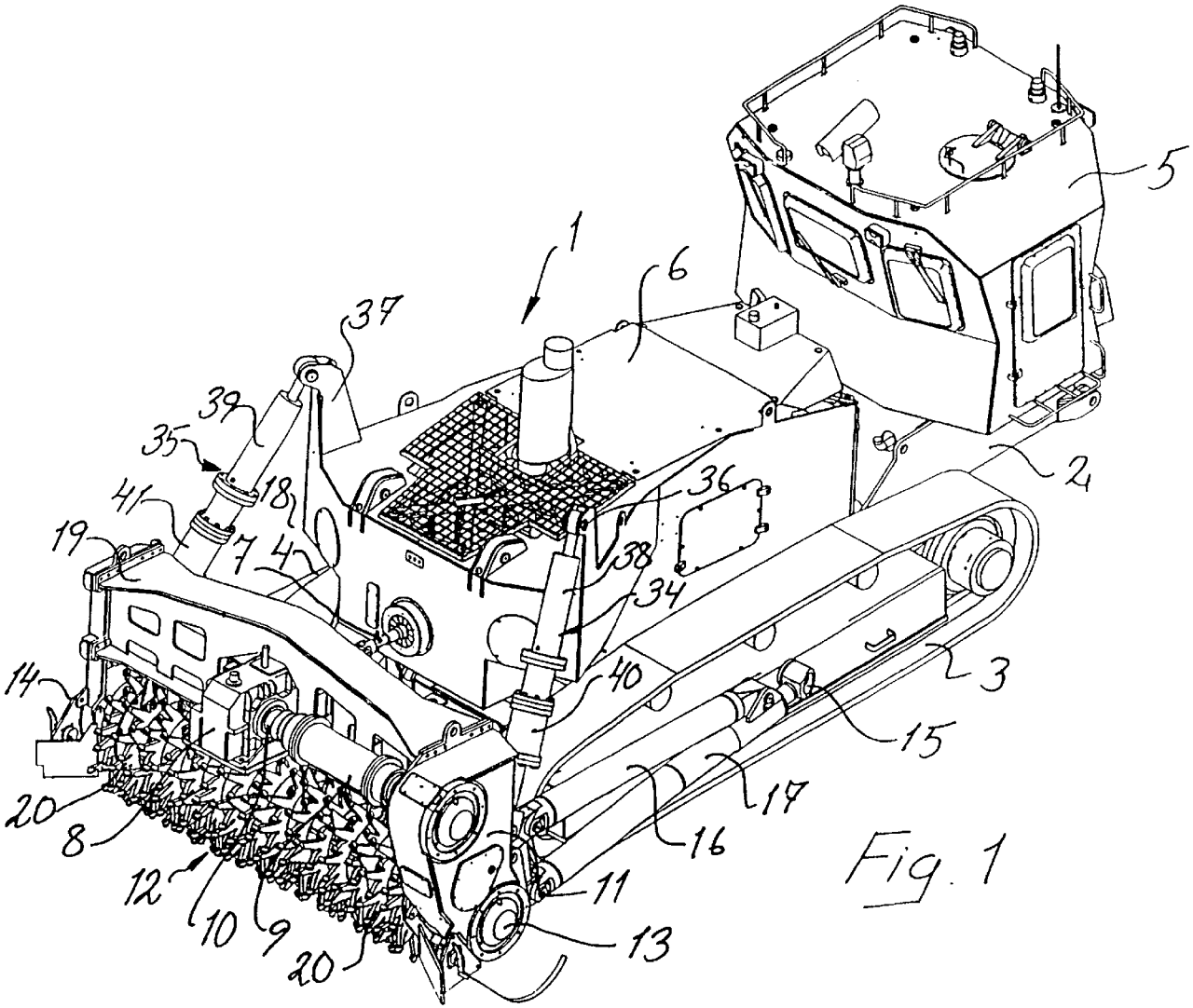

METHOD AND ARRANGEMENT FOR LIMITING THE DAMAGE TO A MINE CLEARANCE VEHICLE IN THE EVENT OF LARGE MINE DETONATIONS

The present invention relates to a method and an arrangement which are used in mechanical mine clearers of the rotary cultivator type and which are intended to limit the damage to the mine clearer when the latter has come across a large mine and caused it to detonate.

Mechanical mine clearers of the rotary cultivator type are a relatively new type of mine clearer and, provided the soil is suitable for mechanical mine clearance, are able, within a short period of time, to clear considerably larger areas than is possible using other currently known clearance methods. The mechanical mine clearer clears all the mines located within its operating range by digging the soil down to a sufficient depth to reach all the mines buried in the soil, and which mines, together with the mines lying loose on the ground surface, it either tears up into smaller non-dangerous parts or causes to detonate.

Mechanical mine clearance can be carried out on all open terrain where the soil can be worked with powerful earth-working equipment, such as a plough and rotary cultivator.

Mechanical mine clearers are expected in particular to gain wide application for mine clearance on looser types of soil and non-permanently covered roadways, especially after a military conflict has ceased. There is a considerable need for this type of mine clearance today in a number of developing countries. One of the problems with the anti-personnel and anti-tank mines which have become so widely used during the twentieth century is that these mines, despite many of them being of a relatively simple construction, have nevertheless had a very long service life and can therefore be extremely dangerous even several decades after being buried. They have also been inexpensive and have therefore been used in large quantities often as weapons of terror against civilian populations in conflict areas.

What makes the mechanical mine clearer especially suited to mine clearance once a conflict has ended is that, if it is correctly constructed, it leaves behind what is in principle guaranteed to be a mine-free area, something which is not so important during a military conflict since the main objective in the latter case is to quickly achieve a mine-free corridor through which one can advance.

Even though the mechanical mine clearer is constructed so as to tear up the mines into non-dangerous parts, as far as possible without these parts detonating, one needs to take into calculation the possibility of a large number of mines detonating in or under the mine clearance equipment. This is therefore normally designed so as to withstand the mine detonations from the smaller and generally more commonly encountered anti-personnel mines, whereas in principle it is practically impossible to manufacture mine clearance equipment which fully withstands a detonation, in its immediate vicinity, of one of the larger types of anti-tank mines, which can contain anything up to 12 kg or more of high-energy explosive.

In order as far as possible to minimize the length of time for which the mechanical mine clearer is out of service after it has been exposed to a large mine detonation of this kind, the mine clearance equipment itself is designed to be easily exchangeable. A precondition for it to be sufficiently easy to replace a damaged mine clearance tool is of course that no damage has been sustained by the tool's suspension or drive unit or by the actual motor vehicle itself.

The present invention now has the object of making available a method and an arrangement which, in the case of mechanical mine clearers of the rotary cultivator type, limit the damage sustained by the mine clearer, in the event of large mine detonations in or under the actual mine clearance tool, to the tool itself. This limitation of the damage is achieved in the first instance by the fact that the mine clearance tool, when acted upon by a large mine detonation, is allowed, by virtue of the construction of the mine clearer, to move away from the detonation site, which in reality means that the tool moves upwards, i.e. is lifted away from the detonation site. This movement is initially damped by dampers of special design also mounted between the tool's suspension and the mine clearance vehicle.

If the detonation acting upon the mine clearance tool is so powerful that the dampers are not fully able to absorb and damp the movement of the tool relative to the rest of the mine clearance vehicle, then, according to the invention, the movement of the tool will be able to continue as a lift and tilt function which will include both the tool and its suspension in the mine clearance vehicle, and the latter's entire engine unit. This function thus entails that the mine clearance tool and the engine together form a rigid unit which is tilted upwards and away from the detonation site about an axis of rotation arranged transverse to the actual direction of movement and fixed in the chassis of the mine clearance vehicle, which axis of rotation is positioned in such a way that more than half of the engine weight loads the tool under normal circumstances.

The possibility of in this way using large parts of the weight of the tool and engine to absorb, by means of a pivoting movement, as much as possible of the energy which the detonation has fed to the system is described in Swedish Patent Application 9702282-6.

This method makes it possible to absorb large amounts of energy by virtue of the fact that it can provide a large lifting distance for a large weight. In order for a mine clearer of the rotary cultivator type to be able to function, a powerful engine is required which is therefore large and heavy, and at the same time the cutting equipment has to be made extremely powerful and, therefore, heavy.

In the case of large anti-tank mines, or if two anti-tank mines were to detonate simultaneously in the equipment, the effect on the mine clearance tool would be so powerful that both the dampers and the above-described upward pivoting function would drop down before the full detonation energy had been consumed. In order to prevent damage to the drive function of the mine clearance tool and its suspension, the mine clearance tool according to the invention has been further designed in a special way and has been provided with specifically constructed deformation zones at the its ends. The purpose of these deformation zones is to permit a total deformation of the mine clearance tool itself, which therefore has also been made easily exchangeable, with less damage to the tools' drive function connected to the engine and the tool's suspension.

The mine clearance tool which is thus designed to function according to the rotary cultivator principle has the form of a central cylindrical roller provided with a large number of toothed roller discs arranged concentrically along its length, where each tooth is additionally preferably provided with an easily exchangeable hard-metal tip which is able to tear up mines and crush stones. This cylinder-shaped roller, provided with discs and teeth, is in turn rotatably mounted in a frame provided for this purpose on the mine clearance vehicle, at one end of which frame the roller communicates with the drive function which, when it is running, drives the cylinder-shaped tool, with its large number of toothed cutting discs, in rotation.

The cutting tool which forms part of the invention is now designed as a double tubular roller comprising two concentrically disposed roller tubes, of which the inner central tube bears the axle journals necessary for the bearing of the tool, while the previously mentioned toothed cutting discs are welded onto the outer tube which thus passes centrally through these. The outer tube is joined to the inner tube via end-plates which have central openings for the axle journals of the inner tube and, arranged concentrically outside these, deformation zones which, in the event of extreme stresses on the outer tube, permit a displacement of the outer tube relative to the inner tube, away from its original concentric position, without the inner tube and its bearing being affected. The deformation zones in the end-plates have been produced by forming a large number of through-holes which are arranged concentrically around the axle journal opening and which are designed in such a way that weakly S-shaped spokes have been formed between them.

The idea behind this construction is that before the stress distributed via the end-plates of the outer tube to the inner tube's axle journals becomes so great that there is a risk of the axle journals and bearings being damaged, these end-plates of the outer tube will be deformed away from the stress point (detonation point of a detonating mine) by means of the fact that the weakly S-shaped spokes on the stress side of the axle journals are pressed together to form a more distinct S-shape while the spokes on the side away from the detonation straighten out. The result of this is that the outer roller tube is displaced away from a position concentric to the inner tube without the inner tube and its roller journals being affected, i.e. the tool is deformed and destroyed without the stresses on its bearings exceeding permitted limits.

Figure 2:
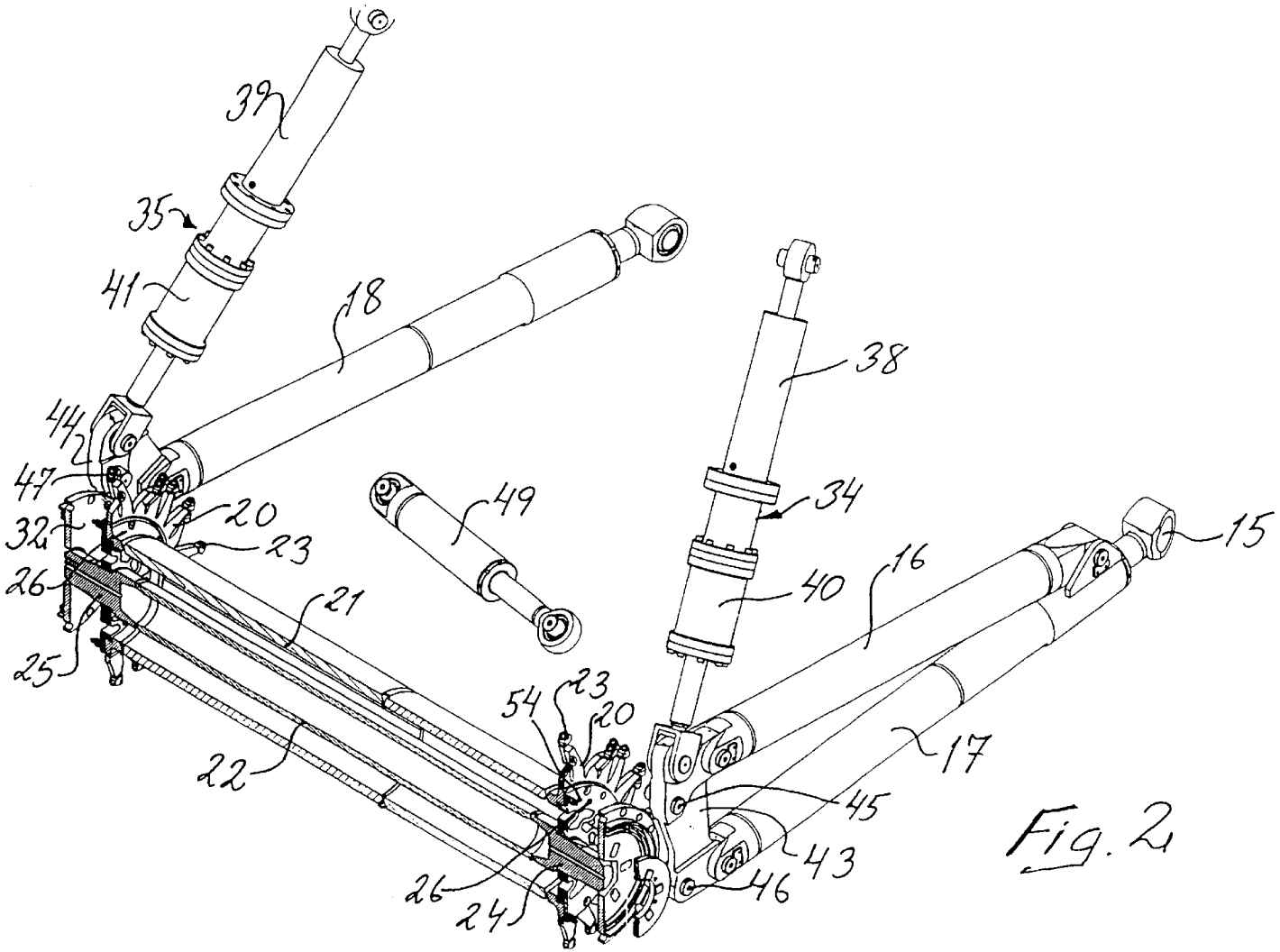
Figure 3:
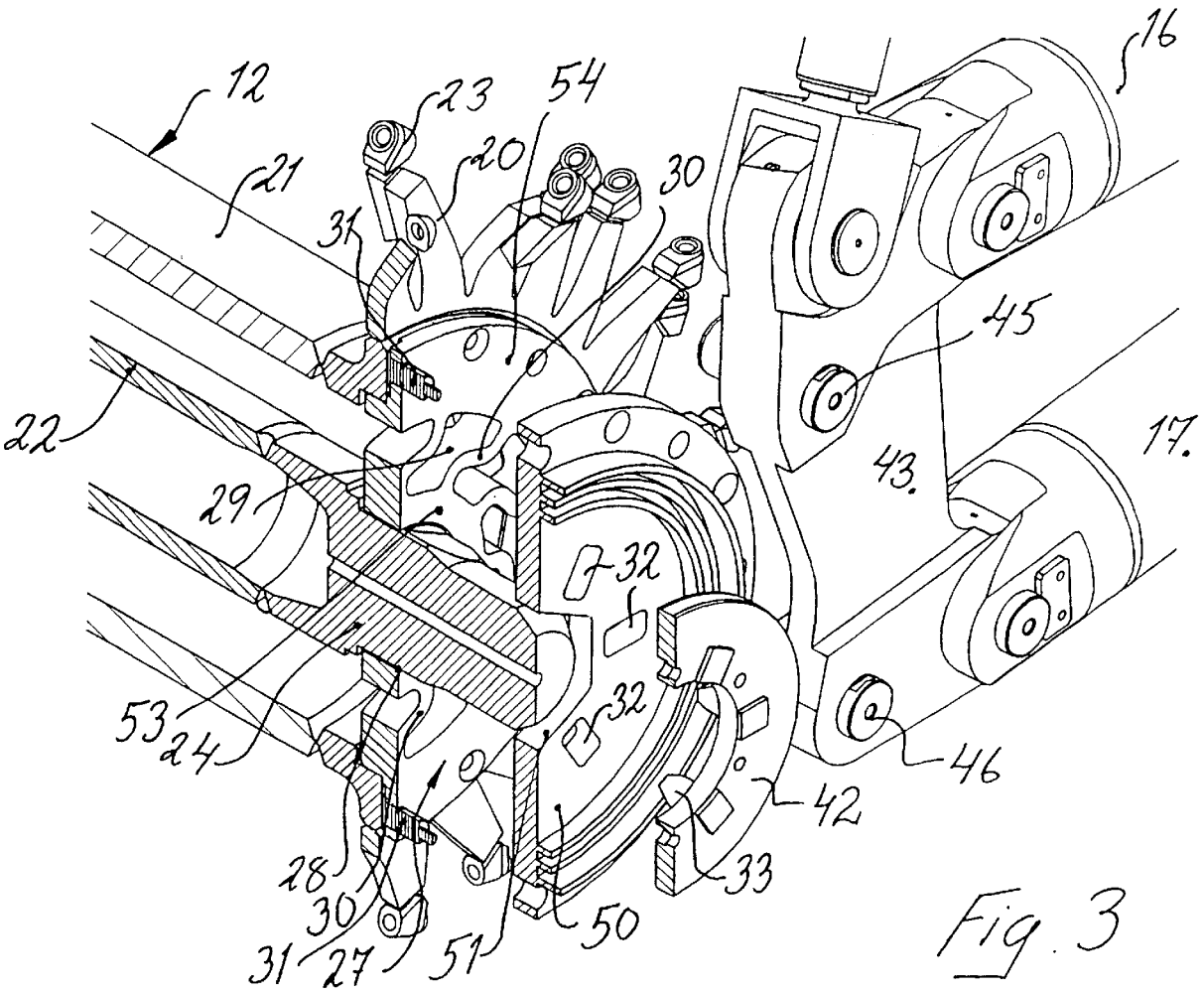

The method and the arrangement according to the invention have been defined in the attached patent claims and the whole invention will now be described in more detail with reference to the attached figures, of which FIG. 1 shows an oblique view of the mine clearance vehicle concerned, FIG. 2 shows a partial view, in partial cross section, of the mine clearance vehicle and of members for its operation, FIG. 3 shows an enlarged view of part of FIG. 2, FIGS. 4–6 are diagrammatic representations of what happens when the mine clearance vehicle runs over a large mine.

The mine clearance vehicle 1 shown in its entirety in FIG. 1 comprises a chassis 2 provided with drive tracks 3, 4 for moving across terrain and on roads, and a control cabin 5. There is also an engine compartment 6 including a main engine which on the one hand drives a rotating mine clearance tool 12, functioning by and large in the manner of a rotary cultivator, via a cardan shaft 7, and, on the other hand, drives the tracks 3, 4 via hydraulic motors (not shown). The whole engine compartment 6 and the mine clearance tool 12 secured to the latter to form a unit with limited mutual movement possibilities is pivotable about a transverse axis which is arranged in the chassis 2 of the mine clearance vehicle 1, extends transverse to the latter and lies level with the outer point of rotation 15 of side bars 16, 17, 18 for the support frame 19 on which the mine clearance tool 12 is rotatably arranged. In normal circumstances, the engine compartment 6, the tool frame 19 and the mine clearance tool 12 move as a unit about the said axis, the tipping function of the unit, which is regulated by hydraulic pistons, defining the working depth of the tool in the soil, while at the same time more than half of the weight of the unit loads the tool 12. The entire tipping function is described in more detail in Swedish Patent Application 9702282-6. When there are no particular stresses on the tool, its position is determined by two hydraulic piston units (concealed in the figure) which are arranged between the front end of the engine compartment 6 and the front end of the chassis 2.

Arranged between the front upper part of the engine compartment 6 and the tool frame 19 there are also two essentially vertically acting but slightly inclined damping bars and tilting piston units 34 and 35. These are secured, on the one hand, in the upper part of the engine compartment 6 and in fixed brackets 36 and 37 and, on the other hand, in the frame 19 of the mine clearance tool 12 at a height level with the points of attachment of the side bars 16–18. On the one hand, hydraulic piston functions 38 and 39 are incorporated in these damping bars 34 and 35, respectively, which hydraulic piston functions allow the lengths of the damping bars to be adjusted within certain limits, which in turn makes it possible to tilt the mine clearance tool, i.e. incline it transverse to the vehicle's position on the ground, and, on the other hand, damping functions 40, 41 are incorporated, each comprising a pretensioning chamber filled with gas and oil and a damping piston displaceable therein. The damping function is achieved by means of oil being forced in a manner known per se past the piston through channels provided and dimensioned for this purpose.

It is this damping function which is always used as the first stage in the three-stage damping of mine detonations acting on the mine clearance tool 12 and which, according to the invention, is used to eliminate the risks of damage to the drive function of the tool. The other two damping functions are the below-described upward tipping of the tool and of the mine clearance vehicle's powerful and heavy engine as one unit relative to the chassis, and, finally, a deformation possibility built into the mine clearance tool with the considerable ability to absorb forces acting on the tool even if it simultaneously means that this is deformed and has to be replaced, something which is nevertheless relatively simple to do. This will in fact only be required after extremely large mine detonations under the tool.

It should further be noted that the side bars 16–18 also comprise mechanical damping functions, for example in the form of built-in spring buffers, which give the side bars a limited spring possibility in the longitudinal direction.

For controlling the tool frame 19 in the lateral direction, a damping member 49 is provided between it and the front lower part of the engine compartment, for example in the form of a spring buffer, which gives the arrangement a limited spring possibility in both directions. This member is not shown in FIG. 1, but its position relative to the tool 12 is indicated in FIG. 2 (but without the frame 19 being shown).

The mine clearance vehicle's main engine incorporated in the engine compartment 6 transmits its drive force to the mine clearance tool 12 via a cardan shaft 7 which connects the engine to an angle gear 8 which is incorporated in the tool frame 19 supporting the mine clearance tool 12 and whose output side is connected to a chain gear 11 via an intermediate shaft 10 provided with torque overload protection 9, which chain gear 11 drives the mine clearance tool 12 via a drive shaft bearing 13. At its opposite end, the mine clearance tool 12 is mounted so as to run freely in the tool frame 19 in the bearing 14.

The large number of toothed cutting discs 20 included in the mine clearance tool 12 can be seen in FIG. 1, while their detailed structure is shown in FIG. 2.

FIG. 2 also shows mounting plates 43 and 44, respectively, on which there are mounted side bars 16 and 17 and damping bar 34, respectively, and side bar 18 and damping bar 35. These mounting plates each have two bolt holes (45–48, of which 48 is not shown in the figures) for attachment of the tool frame 19.

As can be seen from FIGS. 2 and 3, the mine clearance tool 12 consists of an outer cylindrical tube-shaped roller shell 21 and an inner cylindrical tube-shaped central shaft 22. Of the toothed cutting discs 20 welded onto the outer roller shell 21, only two are shown in FIG. 2, while FIG. 1 shows that the number of cutting discs 20 is large. Each such disc is provided with a large number of teeth provided with holders 23 intended for securing loose tooth tips made of hard metal. The tooth tips are not, however, shown in the figures, but only the holders provided for these.

As can also be seen from FIG. 2, the inner tube-shaped central shaft 22 of the mine clearance tool is provided at its outer ends with more robust axle journals 24 and 25, respectively.

The attachment of the outer tube-shaped roller shell 21 on the roller axle can best be seen in FIG. 3.

At its respective outer ends, the roller shell is thus connected to end-plates 26 and 27, respectively. These end-plates have a very specific design in that they have a central opening 28 for each respective axle journal 24, 25, a concentric hub 53 and, arranged concentrically outside the latter, through-holes 29 which between them have weakly S-shaped and essentially radial spokes 30 and an outer flanged ring 54. In the event of an excessive radial transverse force acting on these respective end-plates, for example a force transmitted via the outer roller shell 21 from a mine charge detonating in the tool, the weakly S-shaped spokes 30 on the loaded side come to be twisted so that they are even more S-shaped or completely folded, while the spokes on the side away from the load are straightened to a corresponding extent. The result is therefore that the outer roller shell is displaced away from its original concentric position, at the same time as the force which caused the deformation is used up as deformation work, as a result of which the roller shaft 22 is protected against excessive stresses.

The transfer of the engine torque via the chain gear 11 is provided with certain safety functions in order to avoid damage to the chain gear and the shaft. This includes an inner drive disc 50 which is also provided with a central opening 51 for the axle journal 25 and which in the mounted state bears tightly against the end-plate 27. In terms of rotation, these two discs are joined by means of a number of breakpins 31 which sit securely in the end-plate 27 and protrude into openings in the drive disc 50. Should the end-plate 27 be deformed in the manner described above, the breakpins 31 are sheared off and the discs are displaced relative to each other and the connection between the discs ceases.

The drive disc 50 is moreover provided with a number of connection openings 32 which are arranged concentrically around its central opening 51 and in which, when the mine clearance tool 12 is in the mounted state, a number of drive claws from the gearbox unit 11 engage. Only part of the connection disc 42 on which these drive claws 33 are secured is shown in FIG. 3.

At the other end of the mine clearance tool, the bearing is designed in a corresponding manner, except that the drive disc 50 has been replaced by an end-plate without openings 32 and the drive function and the gearbox 11 have been replaced by a conventional bearing.

Figure 4:
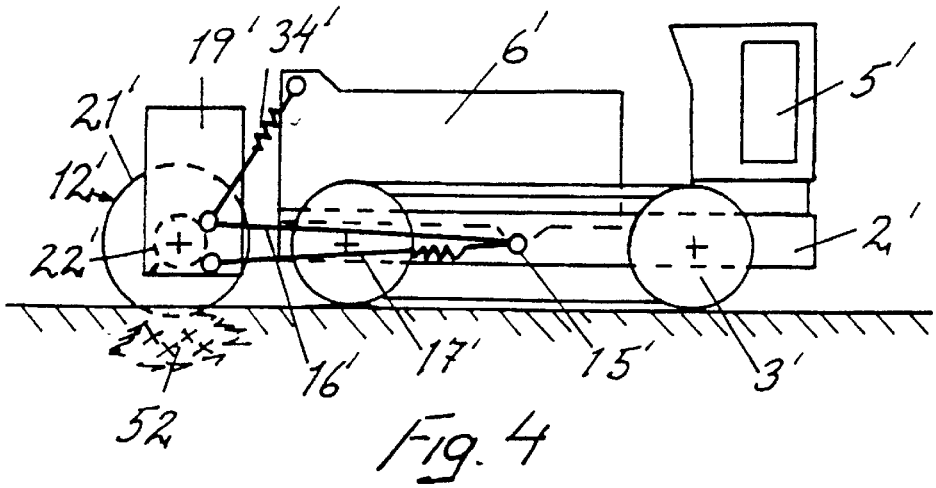
Figure 5:
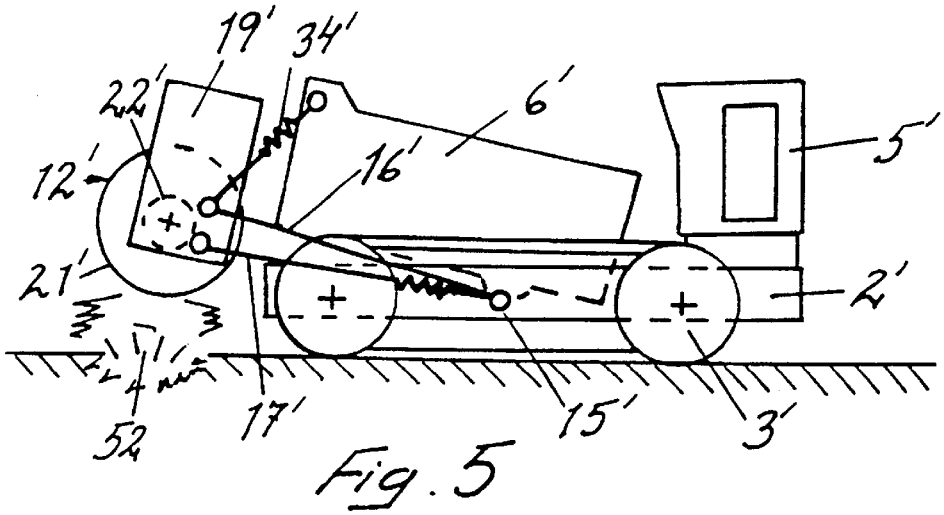
Figure 6:
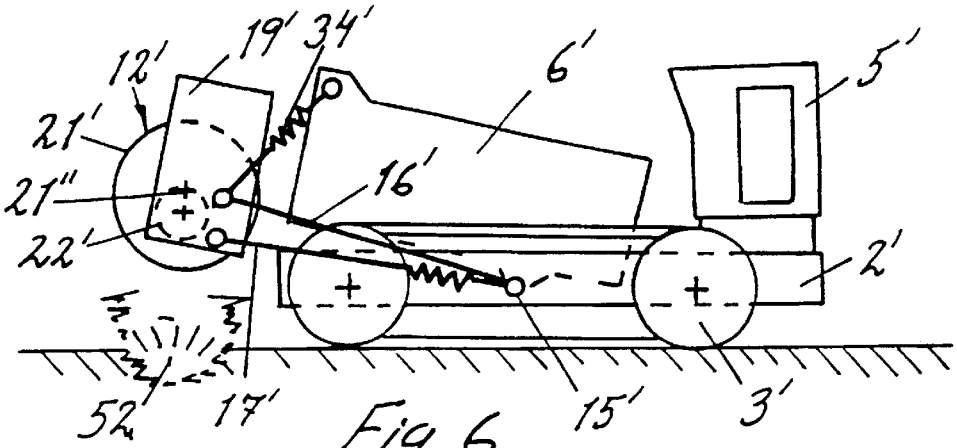

The above-described function sequences have been illustrated even more diagrammatically in FIGS. 4–6. The component parts which are shown in FIGS. 1–3 and which have already been discussed in connection with these figures have now been given the same reference numbers in FIGS. 4–6, but with a prime sign, in order to make clear that these are more schematic parts.

FIG. 4 shows how the mine clearance vehicle with its rotating cutting tool 12' strikes a large mine which is detonated at 52.

The first impact is taken up by the damping functions incorporated in the damping bars and side bars 34', 35' and 16'–18', respectively.

Since the mine detonated at 52 is assumed to be one with high explosive power, the above is not sufficient, for which reason the engine compartment 6' and tool frame 19' with tool 12' are thrown upwards around the axis 15' in the manner shown in FIG. 5.

Since this is not sufficient either to absorb the force of the mine detonation, the actual tool 12' is deformed in the manner which has already been described, which in reality means that the axis of rotation 22' of the tool remains unaffected, while the centre 21" of the outer roller shell 21' is displaced from its position coinciding with 22' to its new position shown in FIG. 6, after which the tool 12' can be replaced.

What is claimed is:

1. A method to minimize damage from detonations of different magnitude to a mine clearance tool, and to the drive function and suspension of a mechanical mine clearer, comprising the steps of:

damping forces between a bearing point of said mine clearing tool and an engine of said mine clearance tool using a damping member;

pivoting a combined unit of said engine and clearance tool upward about a transverse axis on a chassis of said mechanical mine clearer in response to said detonation, wherein said pivoting lifts said combined unit from the locus of said detonation; and deforming a connecting link coupling said mine clearance tool to said bearing point in response to a detonation, wherein said deformation prevents damage to said bearing point.

2. A method according to claim 1, wherein said deforming step further comprises distributing said deformation along a deformation zone, wherein said deformation is a mechanical deformation of a radial spoke connecting a roller shell having a plurality of earth working members to be driven by said engine and where successive mechanical deformation of said radial spoke does not rupture said spoke.

3. A method according to claim 2, wherein said mechanical deformation is distributed via said radial spoke, where the original shape of said radial spoke is twisted in a direction determined by the relative position of said radial spoke to said bearing point and said detonation.

4. A rotary cultivator type mine clearer comprising:

a chassis having drive tracks for moving across a terrain;

a mine clearing tool comprising: a frame, a central drive shaft supporting spaced apart first and second endplates to said frame, an outer roller shell connected to said endplates having a plurality of earth working members, said endplates having a deformation zone which results in relative deformation of said endplates in response to a detonation force applied to said outer roller shell;

an engine connected to said frame at first and second bearing points, and coupled to rotate said endplates and roller shell, said engine and connected mine clearing tool comprising a unit which is connected to said chassis about a pivot point transverse to the longitudinal axis of said chassis, which applies more than one half of the weight of said combined unit on said mine clearance tool, and in response to a detonation force applied to said mining tool pivots said mine clearing tool away from said detonation; and first and second damping members connecting said first and second bearing points to said engine, said damping members reducing the motion between said mine clearing tool and said engine in response to a detonation force applied to said mine clearing tool.

5. Mine clearer according to claim 4, said endplate comprising:

a central shaft opening;

an annular hub arranged outside said central shaft opening, and a plurality of S-shaped spokes, extending radially from said hub relative to said shaft, said spokes coupling said hub to an outer continuous flanged ring, said spokes comprising a prepared deformation zone.

6. Mine clearer according to claim 5, wherein said endplate further comprises a plurality of brake pins, said brake pins coupling said outer roller shell to a drive plate.

7. Mine clearer according to claim 6, wherein said drive plate is coupled to said driving means by a claw coupling.

8. Mine clearer according to claim 4, wherein said earthworking members further comprise:

a plurality of tooth cutting disks, each having an exchangeable tooth points, said disks welded concentrically around said outer roller shell.

* * * * *